US007648257B2

(12) United States Patent
Villard

(10) Patent No.: US 7,648,257 B2
(45) Date of Patent: Jan. 19, 2010

(54) LIGHT EMITTING DIODE PACKAGES

(75) Inventor: Russell G. Villard, Apex, NC (US)

(73) Assignee: Cree, Inc., Durham, NC (US)

( * ) Notice: Subject to any disclaimer, the term of this patent is extended or adjusted under 35 U.S.C. 154(b) by 255 days.

(21) Appl. No.: 11/379,709

(22) Filed: Apr. 21, 2006

(65) Prior Publication Data

US 2007/0247847 A1 Oct. 25, 2007

(51) Int. Cl.
*F21V 29/00* (2006.01)

(52) U.S. Cl. ..... 362/294; 362/249.02; 362/230

(58) Field of Classification Search ..... 362/294, 362/547, 373, 580, 126, 218, 264, 345, 230, 362/249.02; 257/712, 717–722; 165/80.3, 165/185

See application file for complete search history.

(56) References Cited

U.S. PATENT DOCUMENTS

| | | | |
|---|---|---|---|
| 1,565,500 | A | 12/1925 | Ritter |
| 3,927,290 | A | 12/1975 | Denley |
| 4,163,277 | A | 7/1979 | Altman |
| 4,165,851 | A | 8/1979 | Bowden, Jr. et al. |
| 4,219,871 | A | 8/1980 | Larrimore |
| 4,388,677 | A | 6/1983 | Druffel |
| 5,264,997 | A | 11/1993 | Hutchisson et al. |
| 5,386,959 | A | 2/1995 | Laughlin et al. |
| 5,537,301 | A | 7/1996 | Martich |
| 5,588,737 | A | 12/1996 | Kusmer |
| 5,632,551 | A | 5/1997 | Roney et al. |
| 5,697,696 | A | 12/1997 | Kuroda et al. |
| 5,725,302 | A | 3/1998 | Sirkin |
| 5,850,126 | A | 12/1998 | Kanbar |
| 5,934,788 | A | 8/1999 | Wolfe |
| D417,305 | S | 11/1999 | Pahl |
| D417,306 | S | 11/1999 | Pahl |
| D417,307 | S | 11/1999 | Pahl |
| D417,746 | S | 12/1999 | Pahl |
| D417,747 | S | 12/1999 | Pahl |
| 6,076,788 | A | 6/2000 | Akiyama |
| 6,076,936 | A | 6/2000 | George |
| D428,516 | S | 7/2000 | Reo et al. |
| 6,082,870 | A | 7/2000 | George |

(Continued)

FOREIGN PATENT DOCUMENTS

| | | |
|---|---|---|
| DE | 19528459 | 2/1997 |

(Continued)

OTHER PUBLICATIONS

Permlight Product sheet, http://www.permlightforsigns.com/, pp. 1, Feb. 2005.

(Continued)

*Primary Examiner*—Bao Q Truong
(74) *Attorney, Agent, or Firm*—Priest & Goldstein, PLLC

(57) ABSTRACT

Lighting packages are described for light emitting diode (LED) lighting solutions having a wide variety of applications which seek to balance criteria such as heat dissipation, brightness, and color uniformity. The present approach includes a backing of thermally conductive material and two or more arrays of LEDs attached to a printed circuit board (PCB). The PCB is attached to the top surface of the backing and the two or more arrays of LEDs are separated by a selected distance to balance heat dissipation and color uniformity of the LEDs.

20 Claims, 8 Drawing Sheets

U.S. PATENT DOCUMENTS

| | | | | |
|---|---|---|---|---|
| D430,339 | S | 8/2000 | Reo | |
| 6,095,666 | A | 8/2000 | Salam | |
| 6,095,671 | A | 8/2000 | Hutain | |
| D437,446 | S | 2/2001 | Reo et al. | |
| D443,949 | S | 6/2001 | DiMonte | |
| 6,278,607 | B1 | 8/2001 | Moore et al. | |
| 6,292,901 | B1 | 9/2001 | Lys et al. | |
| 6,335,538 | B1 | 1/2002 | Prutchi et al. | |
| 6,340,868 | B1 | 1/2002 | Lys et al. | |
| 6,350,043 | B1 | 2/2002 | Gloisten | |
| 6,357,889 | B1 | 3/2002 | Duggal et al. | |
| 6,416,200 | B1 | 7/2002 | George | |
| 6,428,189 | B1 | 8/2002 | Hochstein | |
| 6,441,943 | B1 | 8/2002 | Roberts et al. | |
| 6,482,520 | B1 | 11/2002 | Tzeng | |
| 6,578,986 | B2 | 6/2003 | Swaris et al. | |
| 6,624,350 | B2 | 9/2003 | Nixon et al. | |
| 6,712,486 | B1 | 3/2004 | Popovich et al. | |
| 6,800,932 | B2 | 10/2004 | Lam et al. | |
| 6,805,474 | B2 | 10/2004 | Walser et al. | |
| 6,846,093 | B2 | 1/2005 | Swaris et al. | |
| 6,864,573 | B2 | 3/2005 | Robertson et al. | |
| 6,949,772 | B2 * | 9/2005 | Shimizu et al. | 257/99 |
| 7,014,336 | B1 | 3/2006 | Ducharme et al. | |
| 7,093,958 | B2 | 8/2006 | Coushaine | |
| 7,102,172 | B2 | 9/2006 | Lynch et al. | |
| 7,108,396 | B2 | 9/2006 | Swaris et al. | |
| 7,114,831 | B2 | 10/2006 | Popovich et al. | |
| 7,121,688 | B2 * | 10/2006 | Rempel | 362/250 |
| 7,213,940 | B1 | 5/2007 | Van De Ven et al. | |
| 7,234,844 | B2 * | 6/2007 | Bolta et al. | 362/294 |
| 7,306,353 | B2 | 12/2007 | Popovich et al. | |
| 7,329,024 | B2 | 2/2008 | Lynch et al. | |
| 7,387,406 | B2 | 6/2008 | Swaris et al. | |
| 7,474,044 | B2 | 1/2009 | Ge | |
| 2003/0006353 | A1 | 1/2003 | Dinh et al. | |
| 2003/0117798 | A1 | 6/2003 | Leysath | |
| 2003/0189831 | A1 | 10/2003 | Yoneda | |
| 2003/0218878 | A1 | 11/2003 | Swaris et al. | |
| 2004/0066142 | A1 | 4/2004 | Stimac et al. | |
| 2004/0212998 | A1 | 10/2004 | Mohacsi | |
| 2005/0077525 | A1 | 4/2005 | Lynch et al. | |
| 2005/0094105 | A1 * | 5/2005 | Otsuka et al. | 353/52 |
| 2005/0099478 | A1 | 5/2005 | Iwase | |
| 2005/0111234 | A1 | 5/2005 | Martin | |
| 2005/0117332 | A1 | 6/2005 | Maack | |
| 2005/0128751 | A1 | 6/2005 | Roberge et al. | |
| 2005/0140270 | A1 | 6/2005 | Henson et al. | |
| 2005/0168986 | A1 | 8/2005 | Wegner | |
| 2005/0237739 | A1 | 10/2005 | Lee et al. | |
| 2005/0243556 | A1 | 11/2005 | Lynch | |
| 2005/0247842 | A1 | 11/2005 | Wronski | |
| 2005/0251698 | A1 | 11/2005 | Lynch et al. | |
| 2005/0274972 | A1 | 12/2005 | Roth et al. | |
| 2006/0061539 | A1 | 3/2006 | Song et al. | |
| 2006/0141851 | A1 | 6/2006 | Matsui et al. | |
| 2006/0187660 | A1 * | 8/2006 | Liu | 362/294 |
| 2006/0243877 | A1 | 11/2006 | Rippel | |
| 2006/0262545 | A1 | 11/2006 | Piepgras et al. | |
| 2006/0267028 | A1 | 11/2006 | Lynch et al. | |
| 2007/0041220 | A1 | 2/2007 | Lynch | |
| 2007/0247414 | A1 | 10/2007 | Roberts | |
| 2008/0055915 | A1 | 3/2008 | Lynch et al. | |
| 2008/0062699 | A1 | 3/2008 | Popovich et al. | |
| 2008/0094850 | A1 | 4/2008 | Woodward | |
| 2008/0192462 | A1 | 8/2008 | Steedly et al. | |

FOREIGN PATENT DOCUMENTS

| | | | |
|---|---|---|---|
| DE | 29921156 | | 5/2000 |
| DE | 20315543 | | 2/2004 |
| DE | 202004003793 | U1 | 5/2004 |
| DE | 102004001940 | | 8/2005 |
| EP | 1081771 | | 3/2001 |
| EP | 1111966 | | 6/2001 |
| EP | 1139019 | A1 | 10/2001 |
| EP | 1139439 | A1 | 10/2001 |
| EP | 1174307 | | 1/2002 |
| EP | 1174307 | A2 | 1/2002 |
| EP | 1512902 | A2 | 3/2005 |
| EP | 1586814 | A2 | 10/2005 |
| EP | 1600691 | | 11/2005 |
| EP | 1674792 | | 6/2006 |
| EP | 1895227 | A1 | 3/2008 |
| FR | 2263458 | | 10/1975 |
| GB | 1494493 | | 12/1977 |
| WO | WO98/43014 | | 10/1998 |
| WO | WO00/34709 | | 6/2000 |
| WO | WO2004/071143 | A1 | 8/2004 |
| WO | WO2006/033998 | A1 | 3/2006 |
| WO | WO2006/127785 | A2 | 11/2006 |
| WO | WO2006/128327 | A1 | 12/2006 |

OTHER PUBLICATIONS

Prescolite Architektur LED Downlights (Sep. 2006) 8 pages.

Narendran et a1., "Solid-state lighting: failure analysis of white LEDs", Journal of Crystal Growth, vol. 268, Issues 3-4, Aug. 1, 2004, Abstract.

* cited by examiner

LIGHT EMITTING DIODE PACKAGES

FIELD OF THE INVENTION

The present invention relates generally to improvements in the field of light emitting diode (LED) packages, and, in particular, to methods and apparatus for achieving color uniformity, desired brightness levels, and passive dissipation of heat when LEDs are arranged to address the varied requirements of different lighting applications.

BACKGROUND OF THE INVENTION

As illustrated by FIGS. 1A, 1B and 1C, a common prior art LED mounting arrangement results in a substantial portion of the light output going upwardly in the direction of a normal to the top surface of a semiconductor photonic chip 12 as seen in FIG. 1B. As seen in FIG. 1A, a top view of an LED 10, the semiconductor photonic chip 12 is mounted on a substrate 14 which is in turn mounted on a bonding pad 16. The chip 12 is encapsulated beneath an optical lens 18 which focuses the light emitted by the chip 12.

FIG. 1B shows a side view of LED 10 with a plurality of light rays relative to a normal, N, to the top surface of chip 12 illustrating the light emitted by chip 12 as it passes out of lens 18. LED 10 is an XLamp™ 7090 from Cree, Incorporated.

FIG. 1C shows an illustrative plot of the light emitted by LED 10 with the y-axis representing the intensity, I, and the x-axis representing the angle, $\theta$, of the emitted light with respect to the normal, N, of FIG. 1B. As illustrated in FIG. 1C, a substantial portion of the light emitted from the LED is along or near the normal, N. Conversely, only a small percentage is emitted sideways. Angle $\alpha$, the angle of intensity, is equal to $2*\theta$.

For further details of exemplary prior art LED packages with the bulk of the light intensity emitted near the normal, N, see, for example, the product literature for the XLamp™ 7090 from Cree, Incorporated.

In regard to FIG. 1B, the angle of intensity revolves around the normal, N, forming a cone of light. A photonic chip may be specifically manufactured to primarily emit white light. Some of these photonic chips may emit a disproportionate amount of yellow light near the edges of the cone of light whereas light emitted at other angles within the angle of intensity emit primarily white light. When this emitted light strikes a diffuser, such as back lighting a curtain or a shield covering an LED light package, for example, yellow rings around a concentration of white light may be visible to the human eye, causing a degradation of color uniformity.

Additionally, when LED 10 is powered on, heat from LED 10 collects along the bottom surface 15 of bonding pad 16. In general, heat radiates from the bottom of photonic chip 12. For example, an LED such as LED 10 may be driven by approximately 350 mAmps and expend 1 Watt of power where approximately 90% of the expended power is in the form of heat. Conventional approaches for dissipating heat generated from an LED include active and passive techniques. A conventional active technique includes employing a fan to blow cooler air onto the back surface of LED 10. Several disadvantages of this conventional technique include its cost, its unaesthetic appearance, and the production of fan noise. One conventional passive technique includes an aluminum panel with large aluminum extrusions emanating from an outer edge of a light fixture. At least a few of the failings of this approach include added cost for materials composing the extrusions, added weight, and limited heat dissipation due to a build up of air pressure resulting from the heated air being trapped by the extrusions.

SUMMARY OF THE INVENTION

As discussed below, among its several aspects, the present invention recognizes the desirability of both increasing brightness and passively controlling heat dissipation of heat generated by powered LEDs and addresses a variety of techniques for addressing such ends. Further, the present invention recognizes that material cost, light weight, and ease of manufacture with a small number of parts are also highly desirable and seeks to address such ends as well.

Some exemplary lighting applications include lighting a horizontal surface, wall washing, back lighting a diffuser, and the like. Each of these lighting applications may have different requirements with respect to brightness levels, lighting patterns, and color uniformity. As multiple LEDs such a LED 10 are arranged to address varied requirements of different lighting applications, the brightness of the collective emitted light and the amount of heat generated per area varies with the arrangement. For example, a particular lighting application may require a high brightness level. To meet the high brightness requirement of the particular lighting application, more LEDs may be arranged closer together in the same predefined area as a lighting application requiring less brightness. However, the closer together LEDs are placed, the more heat is generated in the concentrated area containing the LEDs.

Among its several aspects, the present invention recognizes that an arrangement of LEDs should balance factors such as color uniformity, heat dissipation, material cost, brightness, and the like. In one aspect, the present approach includes a backing of thermally conductive material and two or more arrays of LEDs attached to a printed circuit board (PCB). It is noted that the term "array of LEDs" as used herein means a module of one or more LEDs in various configurations and arrangements. The PCB is attached to the top surface of the backing and the two or more arrays of LEDs are separated by a selected distance to balance heat dissipation and color uniformity of the LEDs.

Another aspect of the present invention includes a plurality of LEDs, a T-shaped bar composed of thermally conductive material, and a printed circuit board (PCB). The plurality of LEDS are attached to the PCB. The PCB is attached to the upper surface of the T-shaped bar to dissipate heat generated from the plurality of LEDs.

Another aspect of the present invention addresses a control system for controlling a plurality of light emitting diode lighting packages. The controls system includes a potentiometer, a plurality of direct current (DC) power supplies, and a control relay switch. Each DC power supply has an analog control port and a positive output terminal. The potentiometer connects to the analog control ports of the DC power supplies. The control relay switch connects the positive output terminal to the plurality of LED lighting packages and controls whether a portion of the plurality of LED lighting packages are powered by the plurality of DC power supplies at any one time. When the potentiometer in the control system is adjusted, a simultaneous brightness adjustment to the portion of the plurality of LED lighting packages connected through the control relay results.

A more complete understanding of the present invention, as well as other features and advantages of the invention, will be apparent from the following detailed description, the accompanying drawings, and the claims.

DETAILED DESCRIPTION

Figure 2A:
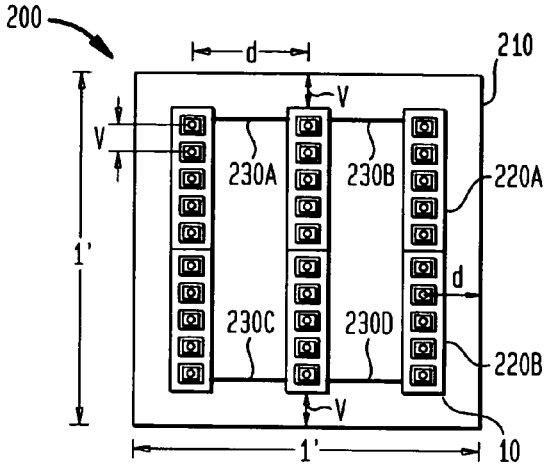
FIGS. 2A and 2B show a top view of two 1 foot×1 foot LED lighting packages in accordance with the present invention.

FIG. 2A shows a top view of a 1 foot×1 foot light emitting diode (LED) lighting package 200 in accordance with the present invention. The LED lighting package 200 includes a backing 210 of thermally conductive material such as aluminum. Backing 210 as shown in FIG. 2 is a planar sheet of aluminum with a thickness of approximately 1/16 inch. It should be noted that other backing constructs may provide additional heat dissipation properties and can be employed in similar arrangements as backing 210. For example, the patent application entitled "Light Emitting Diode Lighting Package with Improved Heat Sink" concurrently filed with this application addresses additional backing structures and is incorporated by reference herein in its entirety.

Also, it is recognized that other thermally conductive materials such as ceramics, plastics, and the like may be utilized. Aluminum is presently preferable because of its abundance and relatively cheap cost. The LED lighting package 200 includes three columns of LEDs. Each column includes two printed circuit boards (PCBs) such as PCB 220A and 220B. On each PCB, five LEDs such as LED 10 are mounted and are electrically connected in serial with each other. Each PCB includes a positive voltage terminal and a negative voltage terminal (not shown). The negative voltage terminal of PCB 220A is electrically connected to the positive voltage terminal of PCB 220B so that the ten LEDs defining a column are electrically connected in serial. It should be recognized that although two PCBs are shown to construct one column of LEDs, a single PCB may be utilized for a particular column of LEDs. Each column of ten LEDs is electrically connected in parallel to its adjacent column by wires 230A-D, respectively. The backing 210 is preferably anodized with a white gloss to reflect the light emitted from the LEDs.

Figure 1A:
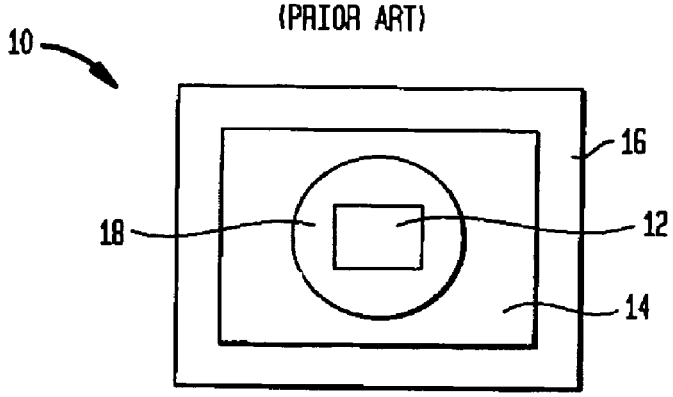
FIG. 1A (PRIOR ART)
FIGS. 1A-1C are top and side views illustrating aspects of a prior art LED packaging arrangement, and a graph illustrating how the intensity of light emission tends to vary with the angle from normal, respectively.
Figure 1B:
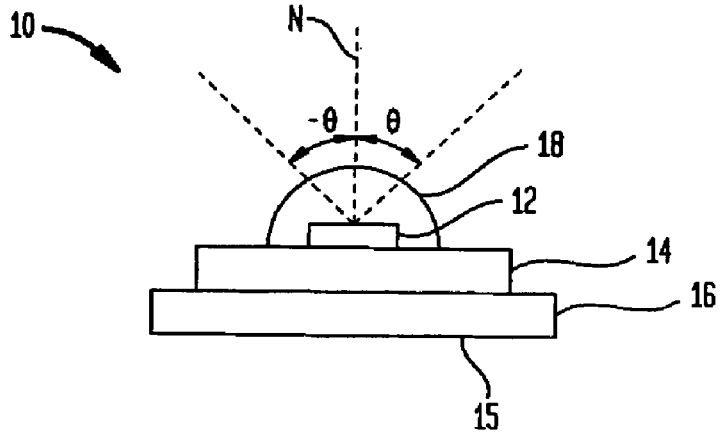
FIG. 1B (PRIOR ART)
Figure 1C:
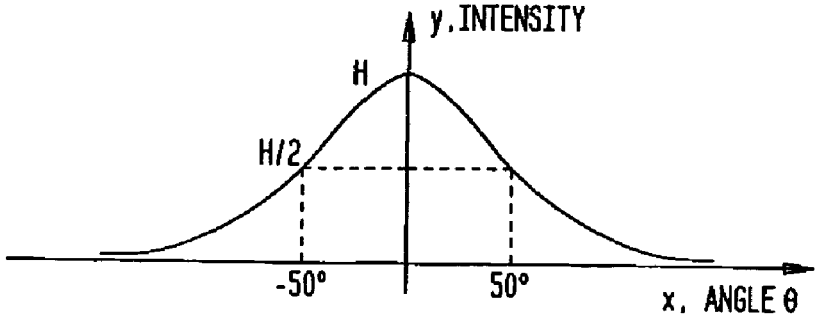
FIG. 1C (PRIOR ART)

The three column arrangement of LEDs as illustrated in FIG. 2A seeks to balance heat dissipation for the LEDs, color uniformity, brightness, and cost in an advantageous manner. The LEDs are positioned in the vertical direction at equidistant spacing, v, and in the horizontal direction at equidistant spacing, d. The spacing is measured from the center of two adjacent LEDs. The exemplary measurements shown in FIG. 2A have the vertical equidistant spacing, v as approximately 1 inch. The vertical equidistant spacing, v, is typically determined by the LED mounting arrangement such as the mounting arrangement shown in FIG. 1A. The horizontal equidistant spacing, d, is approximately 3 inches. If the horizontal spacing is increased beyond approximately d, overall brightness will degrade due to the number of LEDs being able to fit in the 1 foot×1 foot lighting package 200, thermal dissipation will level off, and color uniformity will degrade. These effects of increasing the horizontal spacing beyond approximately horizontal distance, d, results in increased cost of thermally conductive material without recognizing noticeable benefits.

On the other hand, if the horizontal spacing is decreased below horizontal distance, d, in LED lighting package 200, brightness would be increased for two reasons. First, since the number of LEDs in a given area is directly proportional to a corresponding brightness level, by moving the LEDs closer, a higher concentration of LEDs is now provided. Second, by arranging LEDs closer in proximity, more room is now available in a defined area to add additional LEDs into a fixed package such as the 1 foot×1 foot LED lighting package 200. However, the amount of heat generated per square inch would also be increased to a point which exceeds the heat dissipation capacity of utilizing an aluminum planar sheet. Consequently, decreasing the horizontal spacing would require more sophisticated and potentially more costly heat dissipation techniques for the increased level of brightness. For a lighting application which requires a brightness level achieved by the arrangement as shown in FIG. 2A, LED lighting package 200 satisfies the brightness requirement while also providing color uniformity and effective heat dissipation at a reasonable cost. For example, when powering LED lighting package 200 under an ambient temperature of approximately 25° C., the temperature of backing 210 at steady state was approximately 55° C.

Figure 2B:
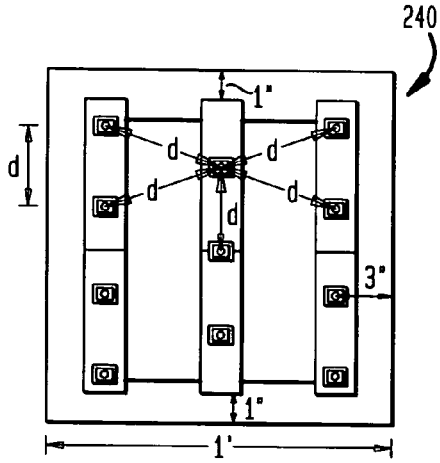

FIG. 2B shows a top view of a 1 foot×1 foot light emitted diode (LED) lighting package 240 in accordance with the present invention. Some lighting applications may not require the same amount of brightness and may be using LEDs which may have nonuniform color along its outer edges of its cone of light, for example, back lighting, accent lighting of objects, and general office lighting applications. LED lighting package 240 addresses those applications which have low brightness level requirements and, thus, need to primarily focus on addressing color uniformity. LED lighting package 240 positions the LEDs so that each of the LEDs are approximately equidistant from an adjacent LED in every direction. As shown in FIG. 2B, eleven LEDs are equally spaced distance, d, inches apart. The distance, d, may vary based on factors such as the interference caused by utilizing LEDs which have different operating characteristics than LED 10, the view distance from an LED lighting package, a layer which may optionally cover the LED lighting package such as a diffuser, an optic, a lens, a collimator, and the laser. Although these factors may be influential, the distance, d, may be approximated by the angle of intensity, a, for a particular type of LED according to the following equation:

$$d=2*(1.25/\tan((180-\alpha)/2))$$

For example, in the 1 foot×1 foot LED lighting package 240 which utilizes LED 10 having an angle of intensity of 100°, d equals approximately three inches. At distance, d, or closer, the intensity of primarily white light emitted from one LED absorbs the yellow light found at the edges of a cone of light emitted by an adjacent LED. Since the total number of LEDs in LED lighting package 240 is eleven, heat dissipation in a 1 foot×1 foot frame is a non-issue. Consequently, d may be decreased and more LEDs may be added without affecting color uniformity until the heat dissipation capacity of backing 210 is maximized.

Figure 3:
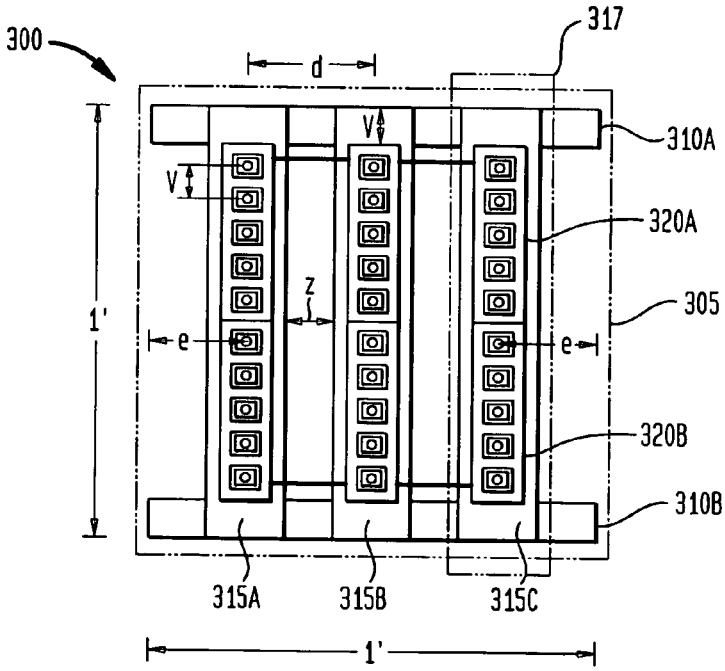
FIG. 3 shows a top view of a 1 foot×1 foot LED lighting packages having an alternative backing arrangement to FIG. 2 in accordance with the present invention.

FIG. 3 shows a top view of a 1 foot×1 foot LED lighting package 300 employing an alternative backing arrangement 305 in accordance with the present invention. Backing arrangement 305 is in the form of a ladder structure. The ladder structure is composed of strips of thermally conductive material such as aluminum and preferably anodized with a white gloss. The ladder structure includes an upper member 310A and a lower member 310B attached to cross members 315A-315C. The cross members 315A-315C as shown in this exemplary embodiment are approximately 1.5 inches wide, 1 foot long, and 1/16 inch thick and are spaced z or approximately 1.6 inches apart. Cross members 315A-315C are attached to members 310A-310B and separated by free space. PCBs such as PCBs 320A and 320B containing an array of five LEDs are attached to the cross members 315A-315C. The combination of cross member 315C with PCBs 320A and 320B compose LED module 317. The vertical equidistant spacing, v, in this exemplary embodiment is approximately 1 inch. The horizontal equidistant spacing, d, in this exemplary embodiment is approximately 2.75 inches. The edge distance, e, as shown in FIG. 3 is approximately 3¼ inches. When powering LED lighting package 200 under an ambient temperature of approximately 25° C., the temperature of cross members 315A-315C at steady state was approximately 55° C.

By utilizing a ladder structure 305, the LED lighting package 300 may now achieve higher brightness levels than LED lighting package 200 with the same heat dissipation because the LED arrays can be positioned closer. Furthermore, since the edge distance, e, is greater than the horizontal distance, d, an additional column of LEDs may be added, further increasing the brightness as will be discussed further in connection with FIG. 5C.

It is noted that although the ladder structure is shown as strips of thermally conductive materially attached to support members, the present invention contemplates alternative techniques of forming a ladder structure such as by stamping out space gaps from a planar backing such as backing 210.

Figure 4A:
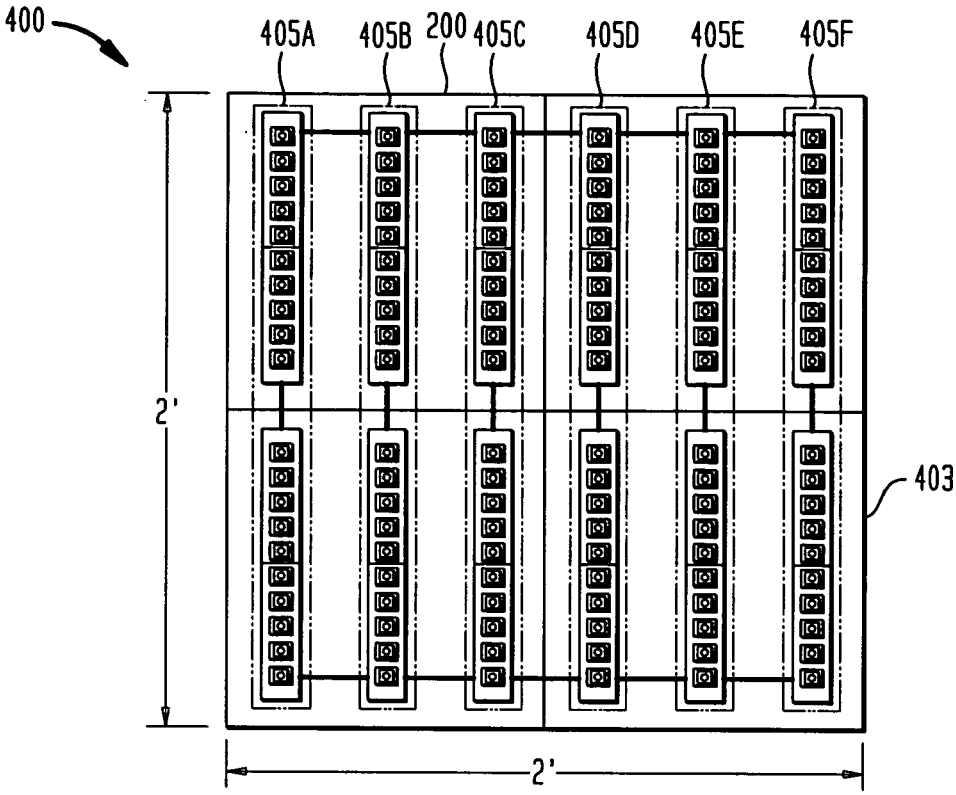
FIGS. 4A and 4B are top views illustrating aspects of two 2 feet×2 feet LED lighting packages.
Figure 4B:
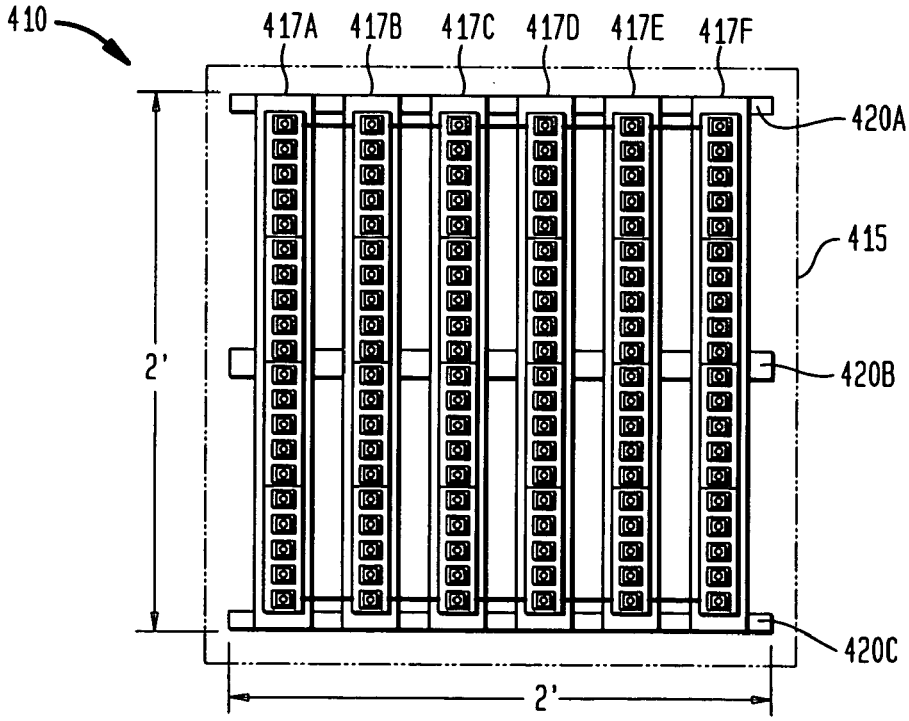

FIGS. 4A and 4B are top views illustrating aspects of two 2 feet×2 feet LED lighting packages. FIG. 4A shows a 2 feet×2 feet LED lighting package 400. LED lighting package 400 comprises six columns 405A-405F of twenty LEDs. Each of the LEDs in a particular column is electrically connected in serial. Each column of LEDs is electrically connected in parallel. LED lighting package 400 is composed of four 1 foot×1 foot LED lighting packages 200 fixedly attached to each other with modified wiring to maintain the parallel electrical connections between columns 405A-405F. The horizontal and vertical spacing of LED lighting package 400 is the same as FIG. 2A. Rather than abutting four separate 1 foot×1 foot LED lighting packages as illustrated in FIG. 4A, LED lighting package 400 may be alternatively constructed utilizing a planar sheet of thermally conductive material for backing 403 and the columns 405A-45F may be fixedly attached to the planar sheet.

FIG. 4B shows a 2 feet×2 feet LED lighting package 410. LED lighting package 410 comprises a ladder structure 415. The ladder structure 415 includes an upper member 420A, an optional middle member 420B, and a lower member 420C. The ladder structure 415 also includes cross members 417A-417F where each member is fixedly attached to members 420A-420C. Each cross member has a column of four PCBs with each PCB having five LEDs mounted thereon. The horizontal and vertical spacing of LED lighting package 410 is the same as FIG. 3. Members 420A-420B and 417A-417F are constructed from a thermally conductive material such as aluminum which is preferably anodized with a white gloss.

It should be noted that the dimensions defining the size of LED lighting packages are illustrative and exemplary.

Figure 4C:
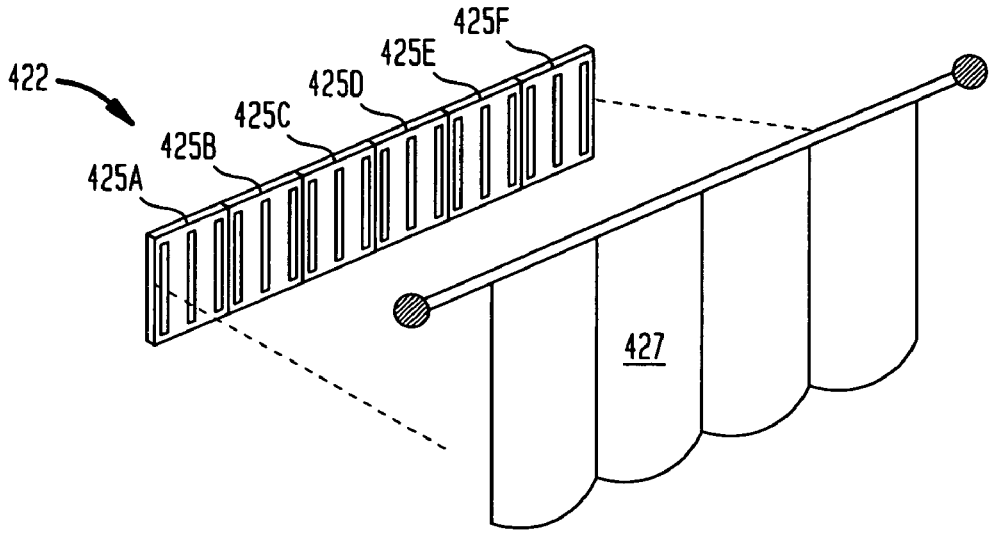
FIGS. 4C-4E are perspective views of lighting applications employing the lighting packages of FIGS. 4A, 4B, and 5C.

FIG. 4C is a perspective view of an exemplary backlight lighting application 422 employing six LED lighting packages 425A-425F. LED lighting packages 425A-425F may suitably be similar to LED lighting packages 200, 240, 300, 400, and 410 and the choice of which LED lighting package to deploy in the exemplary lighting application 422 depends on the brightness level required to illuminate curtain 427, a distance between lighting packages and curtain 427, and aesthetic effect to be accomplished. The distance between the array of LED lighting packages 425A-425F and the curtain 427 is between 5 and 18 inches. For this given distance for a back lighting application, a footprint of area defined by the array of LED lighting packages 425A-425F is preferably 75% of the area of the curtain 427. For example, utilizing six LED lighting packages 201 as the LED lighting packages 425A-425F, a six square foot footprint is defined by six LED lighting packages 201. Curtain 427 would cover eight square feet. Although curtain 427 is one type of diffuser which may used in a back lighting application such as lighting a demonstration booth at a trade show, other diffuser types such as those made from cloth, plastics, nylon, and the like may be utilized within the scope of the present invention. Additionally, another back lighting application may include a screen as the diffuser and a sign being projected on the screen.

Figure 4D:
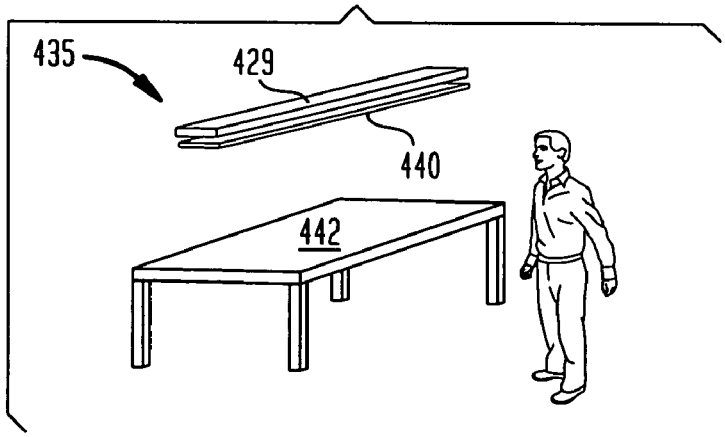

FIG. 4D is a perspective view of an exemplary surface lighting application 435 employing an LED lighting package 429. Exemplary surface lighting application 435 illuminates a conference table 442. LED lighting package 429 has a lighting cover 440 which acts a light diffuser. LED lighting package 429 may suitably be similar to LED lighting packages 200, 240, 300, 400, 410, and 540 and the choice of which LED lighting package to deploy in the exemplary surface lighting application 435 depends on the brightness level required to illuminate conference table 442.

Figure 4E:
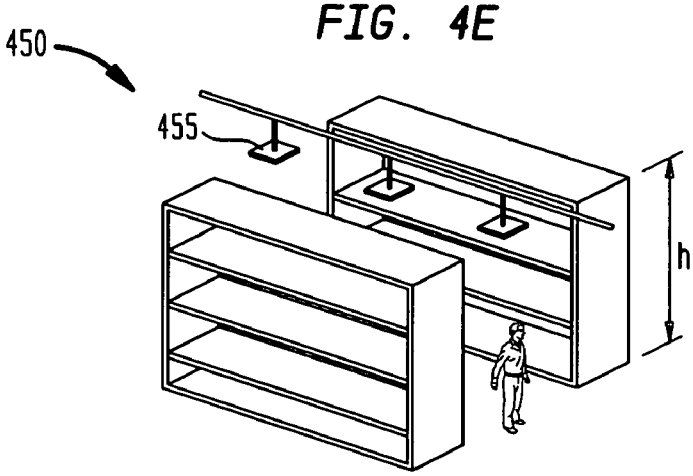

FIG. 4E is a perspective view of an exemplary high bay lighting application 450 employing an LED lighting fixture 455 in accordance with the teachings of the present invention. LED lighting fixture 455 includes an LED lighting package such as LED lighting package 540. LED lighting fixture 455 is placed a distance, h. The distance, h, as shown is 20 feet. However, a typical range for LED lighting fixture 455 is between 8 and 30 feet. LED lighting package 540 will be described further in connection with the discussion of FIG. 5C.

Figure 5A:
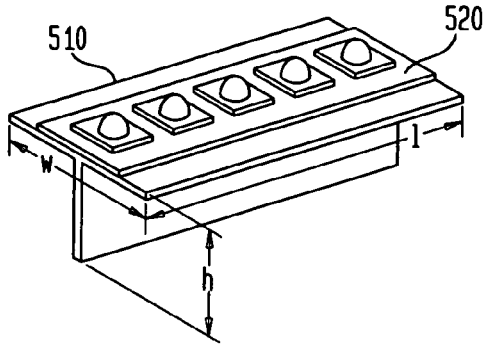
FIGS. 5A-5C (collectively FIG. 5) show T-shaped heat sinks for an array of LEDs according to the present invention.

FIG. 5A shows a perspective view 500 of a T-shaped integrated support heat sink 510 for a PCB 520 having an array of LEDs such as PCB 220A according to the present invention. The T-shaped integrated support heat sink 510 has a width, w, of approximately 1.5 inches and a height, h, of approximately 1 inch. The length, l, is approximately 5.5 inches. However, the length, l, and number of LEDs affixed to a T-shaped heat sink varies depending on the particular type of lighting application. The T-shaped heat sink 510 is made from thermally conductive material and is preferably a T-shaped aluminum bar. PCB 520 is fixedly attached to the T-shaped heat sink 510. The T-shaped heat sink 510 provides heat dissipation of the array of LEDs mounted to PCB 520.

Figure 5B:
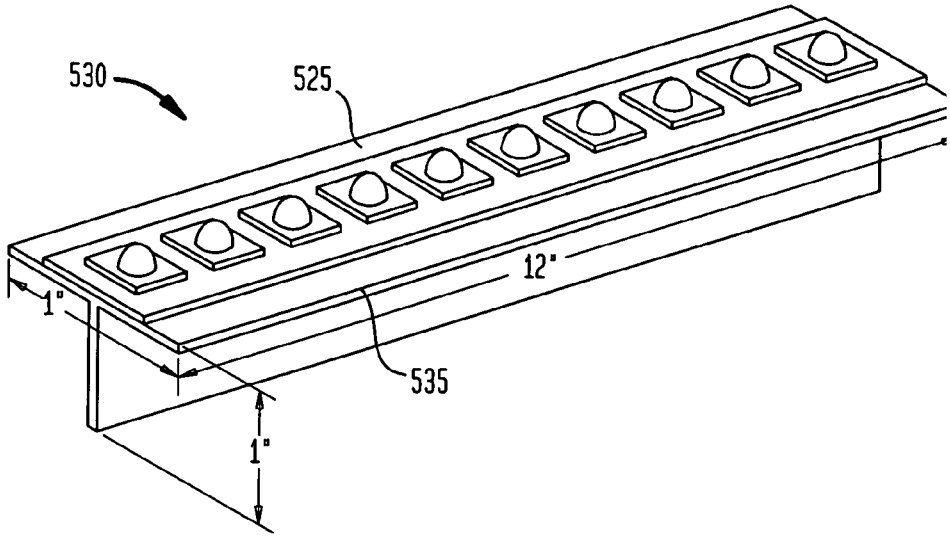

FIG. 5B shows a perspective view of a T-shaped LED array module 530 in accordance with the present invention. T-shaped LED array module 530 include a T-shaped heat sink 525 and a PCB 535 containing ten LEDs fixedly mounted on the top surface of the T-shaped heat sink 525. The T-shaped heat sink 525 has a width of approximately 1 inch, a height of approximately 1 inch, and a length of approximately 12 inches. The T-shaped heat sink 525 is made from thermally conductive material such as aluminum, is approximately 1/16 inch thick, and is optionally painted anodized black.

Figure 5C:
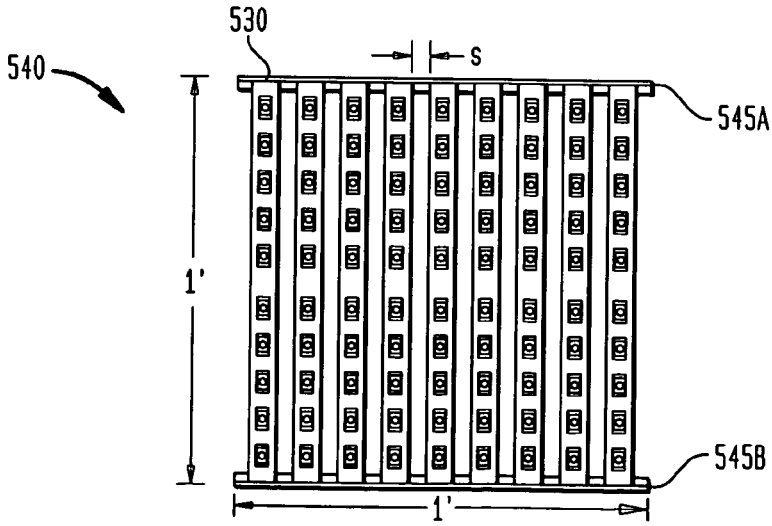

FIG. 5C shows a top view of a 1 foot×1 foot LED lighting package 540 having nine LED lighting arrays such as T-shaped LED array module 530 for a total of 90 LEDs. LED lighting package 540 includes two L-shaped support bars 545A and 545B. The T-shaped LED arrays are attached to the inside surface the L-shaped support bars 545A and 545B and spaced at an equal distance, s, of approximately ¼ inch. Since the LEDs are positioned so close to each other, color uniformity is achieved. Two L-shaped support bars 545A and 545B are optionally anodized in black to help the heat be drawn from the LEDs and are made with thermally conductive material such as aluminum. When powering LED lighting package 200 under an ambient temperature of approximately 30° C., the temperature of cross members 315A-315C at steady state was approximately 62° C. LED lighting package 540 allows 90 one watt LEDs to be placed in close proximity within a 1 foot×1 foot area. LED lighting package 540 may be suitably utilized in a high intensity density (HID) lighting application such as a high bay warehouse lighting application. It is noted that although support bars 545A and 545B are shown as L-shaped, other shaped bars may be utilized such as T-shape and Z-shape support bars.

Figure 6:
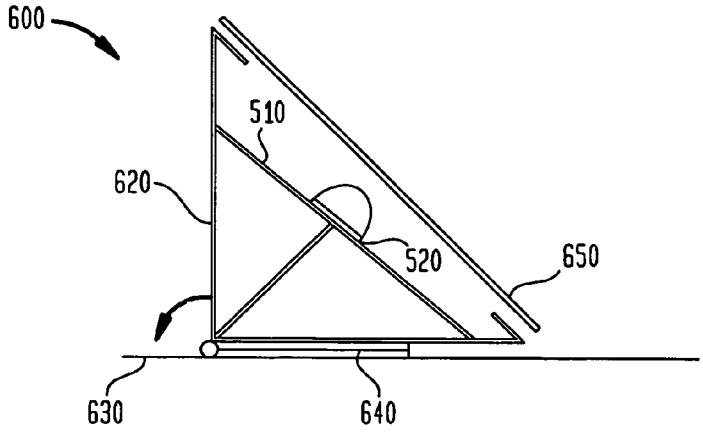
FIG. 6 shows a side view of a lighting package employing the T-shaped heat sink of FIG. 5 in accordance with the present invention.

FIG. 6 shows a side view of a lighting package 600 employing the T-shaped heat sink 510 in accordance with the present invention. The lighting package 600 includes an L-shaped bar 620 having a width of approximately ⅛ inch, a vertical length of approximately 3 inches, and a horizontal length of approximately 2.5 inches. The L-shaped bar 620 is preferably constructed from thermally conductive material such as aluminum. The ends of the L-shaped bar are optionally flanged to support a piece of transparent synthetic resinous material 650 such as acrylic, Plexiglas®, and the like. The flanged ends are approximately 0.25 inches long. The T-shaped heat sink 510 is fixedly mounted to the inner surfaces of the L-shaped bar 620. The bottom outer surface of the L-shaped bar 620 is fixedly mounted to the outer surface of the top portion of a hinge 640. The outer surface of the bottom portion of the hinge 640 is fixedly mounted to plate 630. The hinge 640 allows the light emitted from the array of LEDs 520 to be adjusted and aligned with a subject. The optional piece of transparent synthetic resinous material 650 is mounted on the flanged ends of the L-shaped bar 620. It should be recognized that rather than the L-shaped bar 620, an equal side corner bar may be alternatively utilized.

Figure 7A:
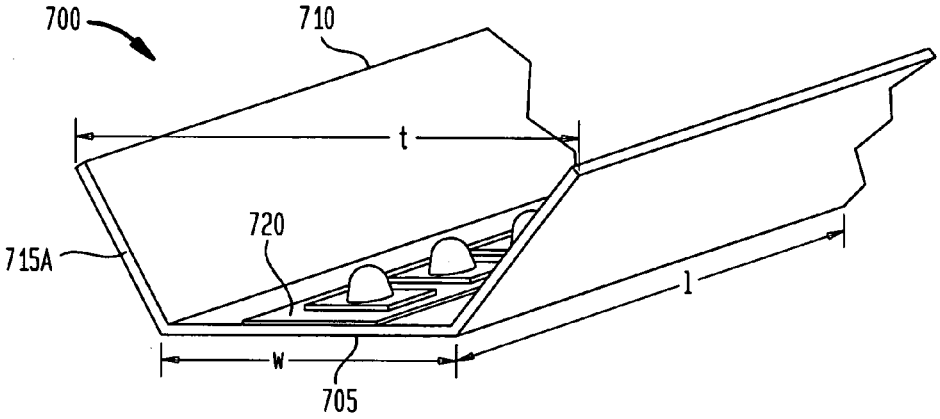
FIGS. 7A-7D show lighting packages which dissipate heat from an array of LEDs mounted therein in accordance with the present invention.

FIGS. 7A-7D show lighting packages which dissipate heat from an array of LEDs mounted therein in accordance with the present invention. FIG. 7A shows a perspective view of a lighting package 700 in the shape of a trapezoidal channel 710. The trapezoidal channel 710 has a base 705 at the bottom of the channel and two sides 715A-715B extending at obtuse angles from the base 705. The trapezoidal channel 710 has a thickness of approximately 1/16 inch and is made from thermal conductive material such as aluminum. Base 705 is approximately 2 inches. The height of the top edge of sides 715A-715B as measured according to a normal line projected to a plane defined by base 705 is approximately 1 inch. The distance, t, between the top edges of sides 715A-715B is approximately 3 inches. The length of the trapezoidal channel 710, l, varies with the particular type of lighting application. The inside surface of the trapezoidal channel 710 is preferably anodized with a white gloss. A PCB 720 containing LEDS is fixedly mounted at the top of base 705. PCB 720 may suitably be similar to PCB 520. Trapezoidal channel 710 serves as a heat sink as well as a LED light package. Other channel shapes may be employed as an LED lighting package.

Figure 7B:
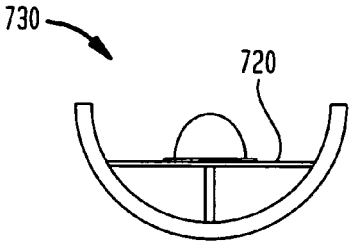
Figure 7C:
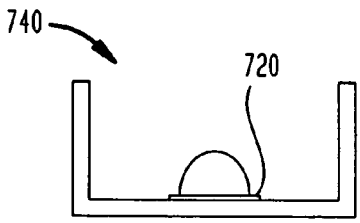
Figure 7D:
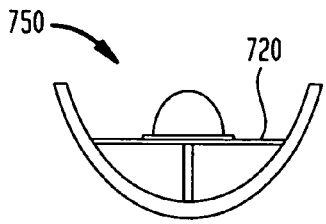

FIG. 7B shows a side view of a lighting package 730 having a channel with constant curvature. FIG. 7C shows a side view of a lighting package 740 in the shape of a rectangular channel. Lighting package 740 has PCB 720 fixedly mounted to the base of the lighting package 740. FIG. 7D shows a side view of a lighting package 740 in the shape of a parabolic channel. Lighting packages 730 and 750 has PCB 720 mounted through a T-shaped heat sink such as heat sink 510. Although not shown, transparent synthetic resinous material such as acrylic, Plexiglas®, and the like may be affixed to the top of LED lighting packages 710, 730, 740, and 750.

The spacing in the above packages balances color uniformity, heat dissipation, brightness, and cost for Cree's XLamp™ 7090 for a particular lighting application and addresses other LEDs having similar operating characteristics of the XLamp™ 7090.

Figure 8:
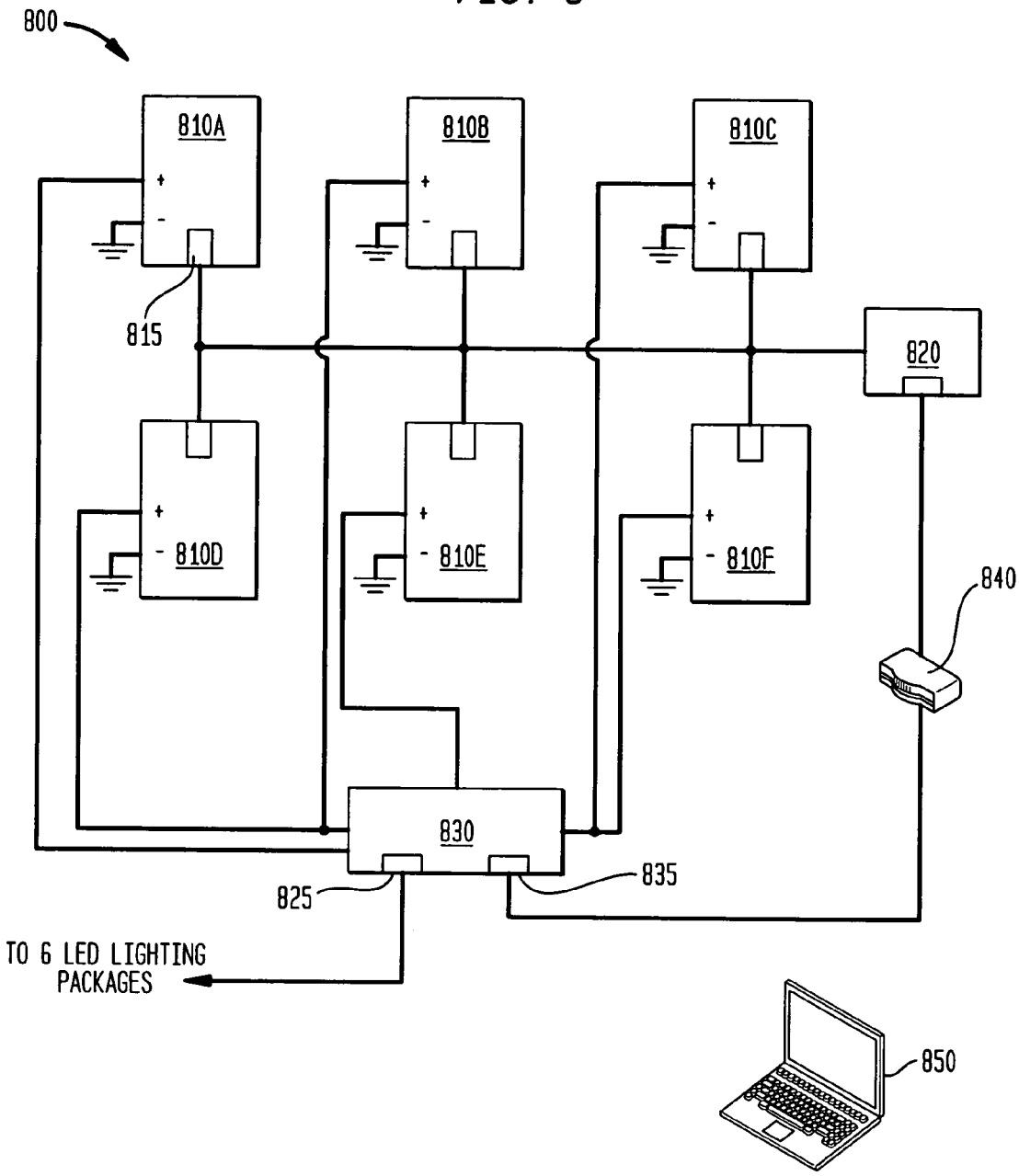
FIG. 8 shows a control system for one or more LED lighting packages according to the present invention.

FIG. 8 shows a control system 800 for one or more LED lighting packages according to the present invention. Referring to FIG. 4C, lighting application 422 utilizes six LED lighting packages. As displayed in FIG. 8, control system 800 may be suitably employed to selectively apply power to one or more of six LED lighting packages and to simultaneously vary the brightness of one or more of the six LED lighting packages. During brightness adjustment, the activated LED lighting packages are adjusted together so as to output the same brightness level.

Control system 800 includes six direct current (DC) power supplies 810A-810F, a potentiometer 820, and an Ethernet control relay switch. Each power supply supplies power to a corresponding LED lighting package such as lighting packages 200, 240, 300, 400, and 410. For the sake of simplicity, only power supply 810A will be described in detail here, but power supplies 810B-810F may suitably be similar and employ similar or identical equipment. Alternatively, power supplies 810B-810F may employ different equipment from that of the item 810A and of one another, so long as they are able to communicate with potentiometer 820. Power supplies 810A-810F may be suitably a constant current supply with appropriate wattage such as model PSI-150W-36, manufactured by PowerSupply1. Power supplies 810A-810F have a positive DC output terminal electrically connected to Ethernet control relay switch 830 and a negative DC output terminal electrically connected to ground. Power supplies 810A-810F also have an analog control port such as analog control port 815 which is electrically connected to potentiometer 820. The potentiometer 820 preferably includes an Ethernet control port and is preferably connected to a wireless router 840. Potentiometer 820 is well known and may include generally available 1 kiloohm, 1 watt potentiometer having an integrated Ethernet. The Ethernet control relay switch 830 includes at least six output ports such as output port 825. Each output port is electrically connected to a corresponding LED lighting package. The Ethernet control relay switch 830 also includes an Ethernet control port 835 which is preferably connected to the wireless router 840. Ethernet control relay switch 830 may suitably be a Smart Relay Controller, manufactured by 6Bit Incorporated having six 10 amp relays. A laptop 850 with a wireless adapter wirelessly communicates with the wireless router 840 to control either the Ethernet control relay switch 830 to selectively power one or more LED lighting packages, the potentiometer 820 to vary together the brightness level of LED lighting packages, or both.

Power supplies 810A-810F receive input from an alternating current (AC) power source (not shown). The AC power source may provide 120 volts (V) at 20 amps (A) or a range of 220V-240V at 20A. The input AC power runs between 50 and 60 hertz (Hz). Referring to LED lighting packages 400 and 410, the output power of power supplies 810A-810F matches the DC operating conditions of at most six columns of 20 serially connected LEDs where each column is electrically connected in parallel. Typically, the designed operating range for an LED such as LED 10 is to receive constant current around 350 mA. Consequently, for each power supply to power an LED lighting package such lighting packages 400 and 410, each power supply outputs 36V at 4.2 Amps.

In operation, the Ethernet control relay switch 830 is controlled by a laptop through its Ethernet port 835 to connect one or more power supplies 810A-810F to their corresponding LED lighting packages. The potentiometer is manually controlled or controlled by laptop 850 to, in turn, vary the output voltage of power supplies 810A-810F simultaneously to the connected LED lighting packages. The combination of relay control and brightness control of the LED lighting packages provides a two dimensional adjustment. With control system 800, Laptop 850 may alternatively employ music to control both the potentiometer 820 and Ethernet control relay switch 830 so that the LED lighting packages emit lighting patterns corresponding to the beat of the music.

While the LED lighting packages have been disclosed in the context of an XLamp™ 7090 from Cree, Incorporated, the dimensions disclosed within a package such as spacing between members may vary based on the operating characteristics of a particular LED such as the XLamp™ 3 7090, XLamp™ 4550, and the like when employed by the LED lighting packages.

It should be noted that according to the teachings of the present invention, LED lighting packages 200, 240, 300, 400, 410, and 540 and T-shaped integrated support heat sink 510 are modular components and may be combined with themselves or with each other to make various arrangements and configurations of larger LED lighting packages to meet specific lighting applications. Additionally, LED lighting packages 200, 240, 300, 400, and 410 and their combinations may be mounted and/or retrofitted into existing non-LED lamp fixtures including fluorescent ceiling fixtures. In retrofitting existing LED lighting packages to existing fluorescent lamp fixtures according to the teachings of the present invention, alternating current (AC) to DC conversion circuitry may need to be added or replaced in a manner known to one having ordinary skill in the art. Alternatively, AC may be supplied to the LED lighting packages.

Furthermore, it is recognized by the teachings of the present invention that various layers may proximately cover LED lighting packages and integrated support heat sinks disclosed herein including diffusers, collimators, optics, lens, and the like. Although dependent on the optical properties of a particular diffuser, a diffuser is generally placed approximately 4 inches from the LEDs in the LED lighting packages to blend the light emitted. Depending on the lighting application or properties of the diffuser, the spacing may be selected to achieve a desired color uniformity or appearance.

Figure 9:
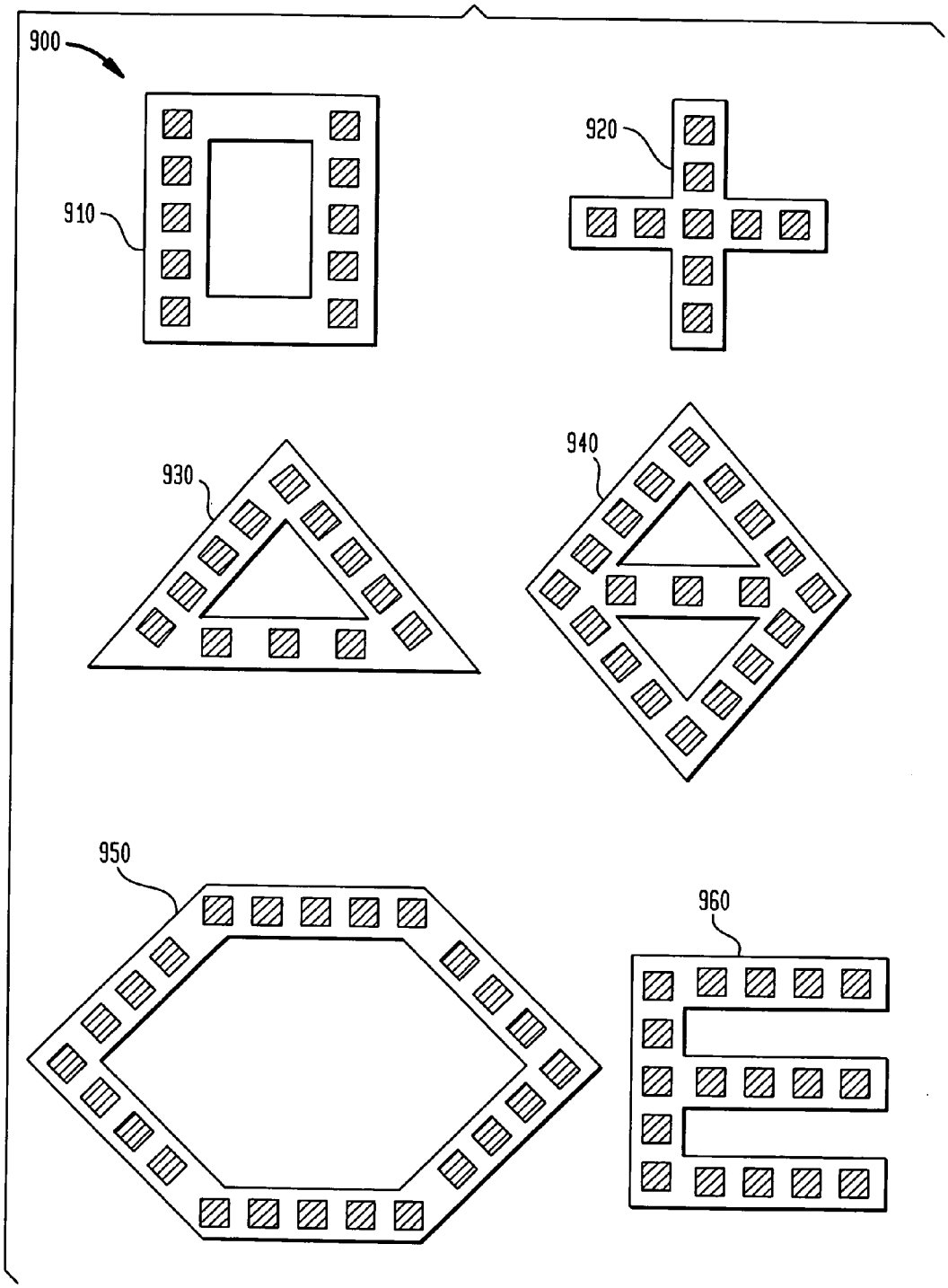
FIG. 9 illustrates various exemplary arrangements of LED module in accordance with the present invention.

An LED module which includes PCB and LED combination mounted on a thermally conductive backing such as LED module 317 is modular and may be arranged to address various configurations according to a specific lighting application. FIG. 9 illustrates various exemplary arrangements 900 of LED modules to define alternative LED lighting packages in accordance with the present invention. Depending on the embodiment, the LED lighting packages may include LED modules and/or support members without LEDs. In certain embodiments, the LED modules or support members have been described as strips, alternative shapes and/or lengths for the LED modules may be utilized.

It should be noted that the printed circuit boards (PCBs) containing one or more LEDs described in the above embodiments is preferably mounted to thermally conductive material utilizing a thermal apoxy such as such as Loctite® 384, other well known techniques including utilizing screws, rivets, and the like are also contemplated by the present invention. Also, the PCBs described above may be painted white to help reflect emitted light or black to help heat dissipation depending on the particular lighting application.

While the present invention has been disclosed in the context of various aspects of presently preferred embodiments including specific package dimensions, it will be recognized that the invention may be suitably applied to other environments including different package dimensions and LED module arrangements consistent with the claims which follow.

I claim:

1. A package of light emitting diodes (LEDs) comprising:

a backing of thermally conductive material; and two or more arrays of LEDs, each array mounted to a printed circuit board (PCB), the PCBs for the two or more arrays attached to the top surface of the backing, said two or more arrays of LEDs separated by a selected distance, d inches apart, where d is approximately equal to $2*(1.25/\tan((180-\alpha/2))$ and $\alpha$ is the angle of intensity, to balance heat dissipation and color uniformity of the LEDs.

2. The package of claim 1 wherein the backing of thermally conductive material is a planar sheet of aluminum.

3. The package of claim 1 wherein the top surface of the backing has a white color to provide diffuse reflection.

4. The package of claim 1 wherein the package dimensions are 1 foot by 1 foot.

5. A package of light emitting diodes (LEDs) comprising:

a backing of thermally conductive material; and two or more arrays of LEDs, each array mounted to a printed circuit board (PCB), the PCBs for the two or more arrays attached to the top surface of the backing, said two or more arrays of LEDs separated by a selected distance, d inches apart, where d is less than $2*(1.25/\tan((180-\alpha)/2))$ but greater than or equal to the smallest distance for which the backing provides adequate heat dissipation and $\alpha$ is the angle of intensity, to balance heat dissipation and color uniformity of the LEDs.

6. The package of claim 5 wherein the two or more arrays of LEDs are electrically connected in parallel.

7. The package of claim 5 wherein the two or more arrays of LEDs where the LEDs operate around 350 mAmps of input current and consume approximately 1 Watt of power.

8. The package of claim 5 wherein the backing comprises two or more strips of aluminum attached to two support members forming an opening framed by said strips of aluminum and said support members, the two or more arrays of LEDs attached to the upper surfaces of the two or more strips of aluminum.

9. The package of claim 5 wherein the backing comprises two or more T-shaped aluminum bars attached to two support members, the two or more arrays of LEDs attached to the upper surfaces of the two or more T-shaped aluminum bars.

10. A module of light emitting diodes (LEDs) comprising:

a plurality of LEDs; and a T-shaped bar composed of thermally conductive material having a uniform thickness, the T-shaped bar comprising a top member having a width and a center and a substantially perpendicular leg member having a height and located substantially at the center of the top member, the width of the top member being at least equal to the height of the perpendicular leg member, and wherein the plurality of LEDs are mounted above the upper surface of the top member of the T-shaped bar and substantially centered above the perpendicular leg member, whereby heat generated from the plurality of LEDs is dissipated by the T-shaped bar.

11. The module of claim 10 wherein the T-shaped bar is anodized black aluminum.

12. A module of light emitting diodes (LEDs) comprising:

a plurality of LEDs;

a T-shaped bar composed of thermally conductive material, the T-shaped bar comprising a top member having a center and a single substantially perpendicular leg member located substantially at the center of the top member;

a printed circuit board (PCB) having the plurality of LEDs attached thereto, the PCB being attached to the upper surface of the top member of the T-shaped bar and substantially centered above the perpendicular leg member to dissipate heat generated from the plurality of LEDs; and an L-shaped bar having two inner surfaces and a lower outer surface, the T-shaped bar attached to the two inner surfaces of the L-shaped bar.

13. The module of claim 12 further comprising:

a plate; and a hinge having a top and bottom outer surface, the bottom surface of the L-shaped bar attached to the top outer surface of the hinge, the bottom outer surface of the hinge attached to the plate allowing the T-shaped bar to rotate about the axis of the hinge.

14. The package of claim 7 wherein the package dimensions are approximately 1 foot by 1 foot.

15. The package of claim 14 wherein three arrays are employed and include a total of at least 30 LEDs.

16. The package of claim 15 wherein during operation at an ambient temperature of approximately 25° C. the backing reaches a steady state temperature of approximately 55° C.

17. The package of claim 15 wherein said at least 30 LEDs have a vertical spacing of approximately 1 inch.

18. The package of claim 1 further comprising a diffuser to form a lighting fixture for room lighting.

19. The module of claim 10 wherein the plurality of LEDs are mounted on a printed circuit board attached to the upper surface of the T-shaped bar, the thermally conductive material is aluminum, and the uniform thickness is approximately one-sixteenth of an inch.

20. The module of claim 19 wherein the T-shaped bar has a height of approximately one inch and a width of approximately one to one and one-half inches.

* * * * *